US011534042B2

(12) United States Patent
Kristiansson et al.

(10) Patent No.: US 11,534,042 B2
(45) Date of Patent: Dec. 27, 2022

(54) VACUUM CLEANER

(71) Applicant: Aktiebolaget Electrolux, Stockholm (SE)

(72) Inventors: Jonas Kristiansson, Stockholm (SE); Jesper Hederos, Stockholm (SE)

(73) Assignee: Aktiebolaget Electrolux

( * ) Notice: Subject to any disclaimer, the term of this patent is extended or adjusted under 35 U.S.C. 154(b) by 115 days.

(21) Appl. No.: 16/771,460

(22) PCT Filed: Dec. 15, 2017

(86) PCT No.: PCT/EP2017/083132

§ 371 (c)(1),
(2) Date: Jun. 10, 2020

(87) PCT Pub. No.: WO2019/114993

PCT Pub. Date: Jun. 20, 2019

(65) Prior Publication Data

US 2021/0068598 A1 Mar. 11, 2021

(51) Int. Cl.

| | |
|---|---|
| ***A47L 5/24*** | (2006.01) |
| ***A47L 9/14*** | (2006.01) |
| ***A47L 9/28*** | (2006.01) |

(52) U.S. Cl.

CPC ..... *A47L 5/24* (2013.01); *A47L 9/1463* (2013.01); *A47L 9/2857* (2013.01)

(58) Field of Classification Search

CPC ... A47L 5/24; A47L 5/225; A47L 5/28; A47L 9/1463; A47L 9/2857; A47L 9/30; A47L 9/322; A47L 9/22; A47L 9/14; A47L 9/1427; A47L 9/1409; A47L 9/16; A47L 9/1608; A47L 9/1675; A47L 9/1683; A47L 9/1691; A47L 9/32

See application file for complete search history.

(56) References Cited

U.S. PATENT DOCUMENTS

| | | | |
|---|---|---|---|
| 1,139,736 | A | 5/1915 | Stabel |
| 1,161,908 | A | 11/1915 | Tice |

(Continued)

FOREIGN PATENT DOCUMENTS

| | | | |
|---|---|---|---|
| CN | 2321380 | Y | 6/1999 |
| CN | 1266666 | A | 9/2000 |

(Continued)

OTHER PUBLICATIONS

English Translation of JP-2003061883 (Year: 2003).*

(Continued)

*Primary Examiner* — Orlando E Aviles
*Assistant Examiner* — Sarah Akyaa Fordjour
(74) *Attorney, Agent, or Firm* — RatnerPrestia

(57) ABSTRACT

A vacuum cleaner having: a profile extending between a profile nozzle end for attachment of a nozzle and a profile handle end for attachment of a first handle; a housing attached to the profile and having a motor fan unit for generating an airflow, a housing air outlet; and a housing air inlet, and an airflow channel extending from the profile nozzle end to the housing air outlet via the housing air inlet, for allowing an airflow from the first profile end to the housing air outlet. The housing is movable along the profile, and has a second handle operable by a user to move the vacuum cleaner.

8 Claims, 6 Drawing Sheets

(56) References Cited

U.S. PATENT DOCUMENTS

| | | | |
|---|---|---|---|
| 1,355,553 | A | 10/1920 | Goughnour |
| 2,074,042 | A | 3/1937 | Bank |
| 2,203,088 | A | 6/1940 | Hansson |
| 2,530,886 | A | 11/1950 | Maisel |
| 2,660,457 | A | 11/1953 | Mallon |
| 2,867,833 | A | 1/1959 | Duff |
| 3,306,634 | A | 2/1967 | Groves et al. |
| 4,050,113 | A | 9/1977 | Wright et al. |
| 4,537,424 | A | 8/1985 | Maier et al. |
| 4,571,772 | A | 2/1986 | Dyson |
| 4,638,527 | A | 1/1987 | Fleischhauer |
| 4,653,137 | A | 3/1987 | Fleischhauer |
| 4,700,429 | A | 10/1987 | Martin et al. |
| 4,939,810 | A | 7/1990 | Ataka |
| 4,955,106 | A | 9/1990 | Stein et al. |
| 5,323,510 | A | 6/1994 | Redding et al. |
| 5,347,679 | A | 9/1994 | Saunders et al. |
| 5,584,095 | A | 12/1996 | Redding et al. |
| 5,584,436 | A | 12/1996 | Sepke |
| 5,794,305 | A | 8/1998 | Weger |
| 5,797,162 | A | 8/1998 | Vystrcil et al. |
| 6,055,703 | A | 5/2000 | Redding et al. |
| 6,065,183 | A | 5/2000 | Hammeken et al. |
| 6,108,861 | A | 8/2000 | Vystrcil et al. |
| 6,125,502 | A | 10/2000 | Hammeken et al. |
| 6,473,934 | B2 | 11/2002 | Lijzenga |
| 6,779,229 | B2 | 8/2004 | Lee et al. |
| 6,823,559 | B2 | 11/2004 | Kaffenberger et al. |
| 7,048,804 | B2 | 5/2006 | Kisela et al. |
| 7,222,393 | B2 | 5/2007 | Kaffenberger et al. |
| 7,251,856 | B2 | 8/2007 | Kaffenberger et al. |
| 7,356,876 | B2 | 4/2008 | Dant et al. |
| 7,353,564 | B2 | 8/2008 | Wertz |
| 7,503,098 | B2 | 3/2009 | Stein |
| 7,805,804 | B2 | 10/2010 | Loebig |
| 7,874,041 | B2 | 1/2011 | Buller et al. |
| 7,895,708 | B2 | 3/2011 | Proud et al. |
| 8,060,981 | B2 | 11/2011 | Basset et al. |
| 8,082,624 | B2 | 12/2011 | Myers |
| 8,141,203 | B2 | 3/2012 | Ashbee |
| 8,181,309 | B2 | 5/2012 | Mersmann et al. |
| 8,296,901 | B2 | 10/2012 | Rosenzweig et al. |
| 8,336,165 | B2 | 12/2012 | Finke et al. |
| 8,448,295 | B2 | 5/2013 | Vines et al. |
| 8,468,647 | B2 | 6/2013 | Lambourn |
| 8,468,649 | B2 | 6/2013 | Nielson et al. |
| 8,479,358 | B2 | 7/2013 | Conrad |
| 8,544,145 | B2 | 10/2013 | Arthey et al. |
| 8,595,897 | B2 | 12/2013 | Vines |
| 8,627,545 | B2 | 1/2014 | Streciwilk |
| 8,661,613 | B2 | 3/2014 | Marsh et al. |
| 8,667,643 | B2 | 3/2014 | Simonelli et al. |
| 8,713,754 | B2 | 5/2014 | Conrad |
| 8,789,238 | B2 | 7/2014 | Myers |
| 8,869,348 | B2 | 10/2014 | Conrad |
| 8,869,349 | B2 | 10/2014 | Henderson |
| 8,887,352 | B2 | 11/2014 | Muhlenkamp |
| 8,950,039 | B2 | 2/2015 | Conrad |
| D725,855 | S | 3/2015 | Burnham et al. |
| D730,001 | S | 5/2015 | Yun et al. |
| 9,215,960 | B2 | 12/2015 | Conrad |
| 9,282,862 | B2 | 3/2016 | Henderson et al. |
| 9,282,864 | B2 | 3/2016 | Guder et al. |
| 9,339,161 | B2 | 3/2016 | McLuckie et al. |
| D759,919 | S | 6/2016 | Smith et al. |
| D770,106 | S | 10/2016 | Johnson et al. |
| D772,510 | S | 11/2016 | Palladino |
| D778,015 | S | 1/2017 | Miller et al. |
| 9,554,680 | B2 | 1/2017 | Elsdon et al. |
| D783,912 | S | 4/2017 | Shin |
| D784,636 | S | 4/2017 | Canas et al. |
| 9,668,631 | B2 | 6/2017 | Conrad |
| D791,421 | S | 7/2017 | Wu et al. |
| 9,901,227 | B2 | 2/2018 | Conrad |
| 9,907,446 | B2 | 3/2018 | Toole et al. |
| 9,943,199 | B2 | 4/2018 | Grey et al. |
| 9,955,831 | B2 | 5/2018 | Bilger |
| 9,962,050 | B2 | 5/2018 | Conrad et al. |
| 10,016,107 | B2 | 7/2018 | Thorne |
| 10,080,471 | B2 | 9/2018 | Reimer et al. |
| D836,863 | S | 12/2018 | Theising et al. |
| 10,149,585 | B2 | 12/2018 | Conrad |
| D837,469 | S | 1/2019 | Johnson et al. |
| D844,914 | S | 4/2019 | Houghton |
| 2002/0042969 | A1 | 4/2002 | Nagai et al. |
| 2006/0000053 | A1 | 1/2006 | Lim et al. |
| 2006/0137134 | A1 | 6/2006 | Dilger et al. |
| 2008/0295282 | A1 | 12/2008 | Olsson et al. |
| 2010/0175217 | A1 | 7/2010 | Conrad |
| 2011/0219567 | A1 | 9/2011 | Conrad |
| 2012/0000030 | A1 | 1/2012 | Conrad |
| 2014/0033469 | A1 | 2/2014 | Toole et al. |
| 2014/0033470 | A1 | 2/2014 | Codling et al. |
| 2014/0033472 | A1 | 2/2014 | Dyson |
| 2014/0331445 | A1 | 11/2014 | Thorne et al. |
| 2014/0366309 | A1 | 12/2014 | Conrad |
| 2014/0366314 | A1 | 12/2014 | Conrad |
| 2015/0040344 | A1 | 2/2015 | Henderson |
| 2015/0135470 | A1 | 5/2015 | Mantyla et al. |
| 2016/0157687 | A1 | 6/2016 | Perez et al. |
| 2016/0157690 | A1 | 6/2016 | Streciwilk et al. |
| 2019/0125147 | A1 | 5/2019 | Svantesson et al. |

FOREIGN PATENT DOCUMENTS

| | | | | | |
|---|---|---|---|---|---|
| CN | 101803892 | A | | 8/2010 | |
| CN | 101813112 | A | | 8/2010 | |
| CN | 107427174 | A | | 12/2017 | |
| CN | 208693159 | U | | 4/2019 | |
| DE | 19630286 | A1 | | 1/1998 | |
| DE | 19630286 | A1 | * | 1/1998 | ..... A47L 9/244 |
| DE | 202004000425 | U1 | | 4/2004 | |
| DE | 202005013078 | U1 | | 11/2005 | |
| DE | 202006011001 | U1 | | 11/2006 | |
| DE | 102009059290 | A1 | * | 6/2011 | ..... A47L 5/225 |
| DE | 102009059290 | A1 | | 6/2011 | |
| EP | 0853917 | A1 | | 7/1998 | |
| EP | 0900045 | A1 | | 3/1999 | |
| EP | 1969988 | A2 | | 9/2008 | |
| GB | 1151990 | | | 5/1969 | |
| GB | 1151990 | A | * | 5/1969 | ..... A47L 5/24 |
| GB | 2447995 | A | | 10/2008 | |
| GB | 2447995 | A | * | 10/2008 | ..... A47L 5/225 |
| GB | 2554937 | A | | 4/2018 | |
| JP | 5261173 | U | | 5/1977 | |
| JP | 6383145 | U | | 6/1988 | |
| JP | 63125947 | U | | 8/1988 | |
| JP | 11309099 | A | | 11/1999 | |
| JP | 2003061883 | A | | 3/2003 | |
| JP | 2003061883 | A | * | 3/2003 | |
| JP | 2012090762 | A | | 5/2012 | |
| JP | 2014124443 | A | | 7/2014 | |
| JP | 2017169895 | A | * | 9/2017 | |
| JP | 2017169895 | A | | 9/2017 | |
| SE | 104383 | C1 | | 4/1942 | |
| SE | 334712 | B | | 5/1971 | |
| WO | 8607247 | A1 | | 12/1986 | |
| WO | 9911170 | A1 | | 3/1999 | |
| WO | 2004103144 | | | 12/2004 | |
| WO | 2015020673 | A1 | | 2/2015 | |
| WO | 2016141960 | A1 | | 9/2016 | |
| WO | 2017186280 | A1 | | 11/2017 | |

OTHER PUBLICATIONS

English Translation of JP-6604881, Patented Version of JP-2017169895 (Year: 2017).*

English Translation of DE-19630286 (Year: 1998).*

English Translation DE-102009059290 (Year: 2011).*

Japanese Notice of Reasons for Refusal for Japanese Application No. 2018-546841, dated Nov. 5, 2020, 2 pages.

Non Final Office Action for U.S. Appl. No. 16/095,525, dated Nov. 20, 2020, 29 pages.

(56) References Cited

OTHER PUBLICATIONS

Chinese Office Action for Chinese Application No. 201780097599.7, dated May 18, 2021, with translation, 17 pages.
International Preliminary Report on Patentability for International Application No. PCT/EP2017/083132, dated Jun. 16, 2020, 7 pages.
International Search Report and Written Opinion for International Application PCT/EP2017/083132, dated Jun. 27, 2018, 10 pages.
Non Final Office Action for U.S. Appl. No. 29/634,734, dated Oct. 11, 2019, 6 pages.
Japanese Notice of Reasons for Refusal for Japanese Application No. 2018-546841, dated Apr. 2, 2020 with translation, 7 pages.
International Search Report and Written Opinion for International Application No. PCT/EP2016/059339, dated Dec. 21, 2016, 8 pages.
Japanese Notice of Reasons for Refusal for Japanese Application No. 2020-530571, dated Jun. 21, 2021, 4 pages.
Chinese Office Action for Chinese Application No. 201780097599.7, dated Dec. 16, 2021 with translation, 13 pages.

* cited by examiner

VACUUM CLEANER

TECHNICAL FIELD

The present invention relates to a vacuum cleaner.

BACKGROUND

Different kinds of stick type vacuum cleaners are known. This type of vacuum cleaner generally has an elongated body with a nozzle in one end and a handle in the other end. A housing with a fan and filter may be attached to the elongated body and may extend substantially in parallel thereto. Such housing may comprise a fan and motor, a dust collector, a filter and other necessary parts.

Handheld vacuum cleaners allow a user to remove dust and debris in a relatively easy and efficient manner and may be operated with a single hand grip.

In some stick type vacuum cleaners the housing is detachable from the elongated body and may be used independently as a handheld vacuum cleaner separate from the elongated body. This may be practical e.g. for sucking up crumbs from tables and similar. This also allow a user to reach surfaces where a nozzle of the body would not fit. In EP1969988 an example of such a vacuum cleaner is disclosed.

A drawback with many upright/stick type vacuum cleaners is that it is difficult to vacuum clean under beds, sofas and the like, since the housing may restrict how far the nozzle may reach. In other words, the housing may hit the bed/sofa when a dimension of the housing is larger than the height between the bed/sofa and the floor to be cleaned.

Further, it may be a challenge to efficiently use the vacuum cleaner on surfaces above a certain height, such as walls, shelfs and ceilings, since the design of the handheld vacuum cleaner is generally optimized for floor-cleaning.

In GB1151990 some of these problems or disadvantages are addressed. A housing of the vacuum cleaner in GB1151990 may be moved between different positions. Hereby a user may access surfaces under low furniture's and similar. The vacuum cleaner disclosed in GB1151990 works well in some applications, but there remains a need improvements with regards to efficiency, flexibility and ergonomics.

SUMMARY

An object is to provide an improved vacuum cleaner.

This object is attained in an aspect of the invention by a vacuum cleaner comprising a profile extending between a profile nozzle end for attachment of a nozzle and a profile handle end for attachment of a first handle, a housing attached to the profile, the housing comprising a motor fan unit for generating an airflow, a housing air outlet and a housing air inlet, and an airflow channel extending from the profile nozzle end to the housing air outlet via the housing air inlet, for allowing an airflow from the first profile end to the housing air outlet. The housing is arranged with a second handle operable by a user to move the vacuum cleaner. This is advantageous, since upon operation of the vacuum cleaner by a user, the user may operate the vacuum cleaner by holding both the first handle and the second handle. For instance, the user may want to lift the vacuum cleaner from the floor, for instance for cleaning a wall, a table, a windowsill or even a ceiling. In prior art cleaners comprising only a first handle at an upper end of the vacuum cleaner profile, this is a very heavy operation to perform. By using a two-hand grip utilizing both the first handle and the second handle, the lifting operation is greatly mitigated.

In an embodiment, the housing is arranged on an upper side of the profile. In contrast to having the housing arranged on an under side of the profile, this advantageously allows for better reach under objects such as sofas and beds.

In an embodiment, the housing is arranged to be moveably attached to the profile, wherein the housing is moveable along at least a part of the length of the profile. Advantageously, this provides for great flexibility since the user may move the housing to a position relatively near the nozzle when vacuum cleaning a floor and may move the housing to a position closer to the first handle portion e.g. when he/she is vacuum cleaning walls, ceilings, stairs, etc.

In another embodiment, the profile comprises a first profile part and a second profile part, where the second profile part is arranged to at least partly enclose the first profile part and the first profile part is slidable in the second profile part for adjustment of a length of the profile. Advantageously, since the first profile part is slidable or retractable in the second profile part even greater flexibility is achieved. A user may extend the profile when necessary, such that he/she may use the vacuum cleaner in a standing position, and may retract the profile, e.g. when using the vacuum cleaner in a staircase or similar.

In an embodiment, the user may thus change both the length of the profile and the gravity point of the vacuum cleaner. Hereby the vacuum cleaner advantageously enables efficient, flexible and ergonomic vacuum cleaning. This further allows the vacuum cleaner to have relatively more weight if necessary. This has proven to be very useful when the vacuum cleaner is equipped with a powerful motor and a battery with some weight.

In a further embodiment, the profile comprises at least one opening via which the airflow enters the housing air inlet. If the housing is arranged to be movably attached to the profile at different positions, a plurality of openings or one single elongated opening is provided.

In yet another embodiment, the profile comprises opening cover means, arranged to allow the airflow channel to a section of the opening where the housing air inlet is positioned. According to some embodiments, the opening cover means are arranged to close off the remaining openings, or sections of the single opening. This enables an efficient flow and a strong suction force from the nozzle profile end to the housing. The opening covering means may also prevent smaller objects from getting stuck in the opening(s) and may prevent a user from jamming his/her fingers in the opening(s) when moving the housing along the length of the profile.

In still another embodiment, the vacuum cleaner further comprising a constant force spring mounted at the profile handle end inside of the profile, the constant force spring being attached in one end to be extended to the housing, wherein the said one end to be extended moves with the housing. Advantageously, the constant force spring will provide a resilient support for the housing and facilitate holding the housing in place and thus prevent the housing from uncontrollably moving in a downwards direction towards the nozzle.

Further in an embodiment, a part of the spring being extended may advantageously act as cover means for any openings in the profile which are not aligned with the air inlet of the housing. A further cover means may also be used for the part of the profile located downstream of the housing for covering any openings located downstream of the housing. In case of using an open profile, the single elongated opening not being aligned with the housing air inlet is covered by the constant force spring upstream of the housing, and by a further cover means downstream of the housing.

In an embodiment, the first handle is arranged to be pivotally attached to the profile handle end. This advantageously allows a user to adjust a handle positions in accordance to his/her preferences. The handle also may be used to extend or shorten a length of the vacuum cleaner.

According to an embodiment, the handle comprises a control arrangement for control of at least one of a fan effect and a nozzle function. Hereby a flow rate of air may advantageously be adjusted. A user may also efficiently control one or more nozzle functions, such as nozzle lights, a brush roller or the like via the control arrangement.

Generally, all terms used in the claims are to be interpreted according to their ordinary meaning in the technical field, unless explicitly defined otherwise herein. All references to "a/an/the element, apparatus, component, means, etc." are to be interpreted openly as referring to at least one instance of the element, apparatus, component, means, etc., unless explicitly stated otherwise.

BRIEF DESCRIPTION OF THE DRAWINGS

The various aspects of embodiments herein, including its particular features and advantages, will be readily understood from the following detailed description and the accompanying drawings, in which.

DETAILED DESCRIPTION

Embodiments herein will now be described more fully with reference to the accompanying drawings, in which embodiments are shown. Well-known functions or constructions will not necessarily be described in detail for brevity and/or clarity.

Figure 1:
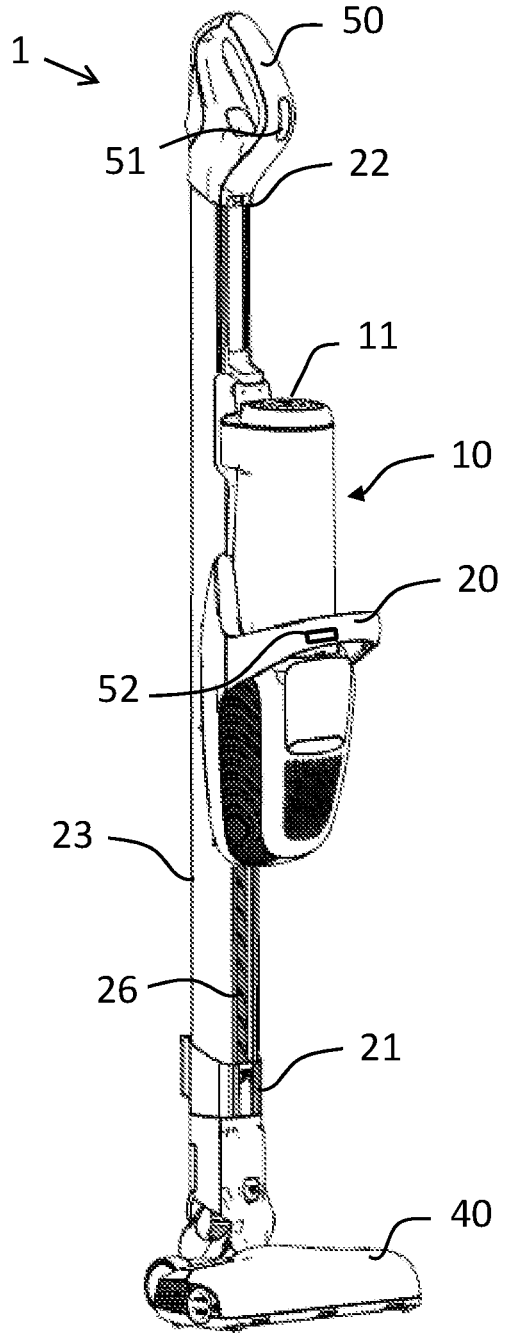
FIG. 1 illustrates a perspective view of a vacuum cleaner according to an embodiment.

FIG. 1 illustrates a vacuum cleaner 1 according to an embodiment in perspective view. This particular type of vacuum cleaner is known as an upright cleaner or stick cleaner. The vacuum cleaner may be powered by a chargeable battery, an electric cable or a combination of the two.

Figures 5A, 5B, 5C:
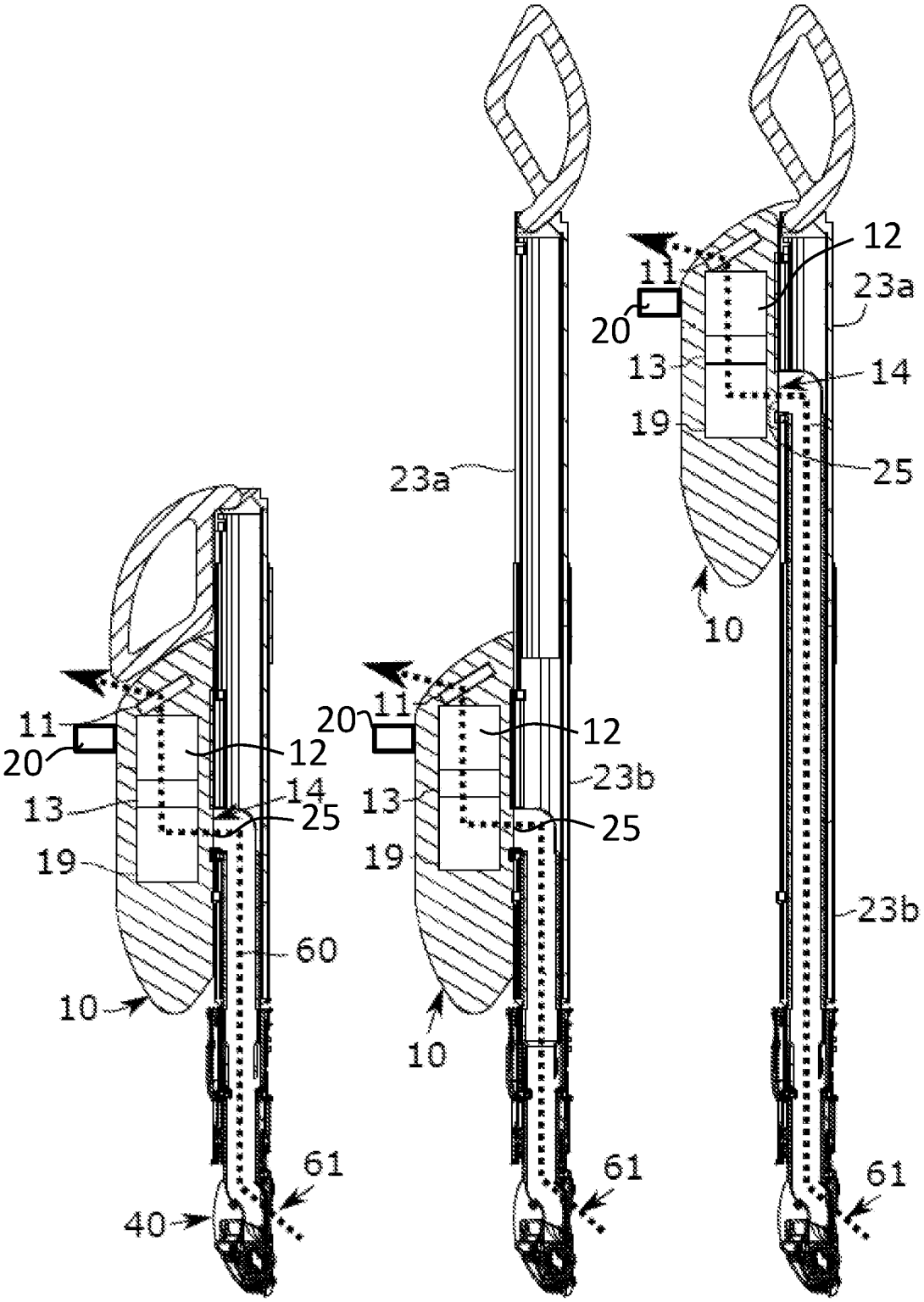
FIG. 5*a* illustrates a cross section of the FIG. 4*a* vacuum cleaner.
FIG. 5*b* illustrates a cross section of the FIG. 4*b* vacuum cleaner.
FIG. 5*c* illustrates a cross section of the FIG. 4*c* vacuum cleaner.

The vacuum cleaner 1 comprises a housing 10. The housing 10 may be made as a hollow body or structure for housing some parts of the vacuum cleaner 1. The housing 10 may comprise a motor fan unit for generating airflow. A schematic airflow and a schematic motor fan unit are illustrated in FIGS. 5*a*-5*c*. The housing 10 also comprises a housing air outlet 11 and a housing air inlet, also illustrated in FIGS. 5*a*-5*c*. In FIG. 1, the housing 10 is arranged on an upper side of the profile 23. Advantageously, this allows for better reach under objects such as sofas and beds.

The vacuum cleaner 1 further comprises a profile 23 to which the housing 10 is attached. The profile 23 extends between a profile nozzle end 21 located downstream towards a nozzle 40 and a profile handle end 22 located upstream towards a first handle 50 to be held by a user for moving the vacuum cleaner over a surface to be cleaned. The handle 50 may optionally comprise a control arrangement 51, e.g. a push button or a slider, for control of at least one of a fan effect, a nozzle function or any other vacuum cleaner function which may need to be adjustable. Hence, the control arrangement 51 can be operated by a user to turn the vacuum cleaner 1 on/off.

In an embodiment, the second handle 20 comprises a control mechanism 52 arranged to control at least one of a fan effect and a nozzle function. Hence, both the control arrangement 51 of the first handle 50 and the control mechanism 52 of the second handle 52 can be used for controlling functionality of the vacuum cleaner 1, such as turning the vacuum cleaner on/off.

The profile 23 comprises at least one opening (arranged underneath the housing 10) for allowing an airflow to flow from the first profile end 21 to the housing air inlet and out through the housing air outlet. The profile 23 may be referred to as an elongated profile or the like. A cover means 26 in the form of e.g. a flexible cover strip may be used for covering any openings in the profile 23

In contrast to prior art upright vacuum cleaners, the vacuum cleaner 1 of the embodiment of FIG. 1 further comprises a second handle 20 attached to the housing 10.

This is advantageous, since upon operation of the vacuum cleaner 1 by a user, the user may operate the vacuum cleaner 1 by holding both the first handle 50 and the second handle 20. For instance, the user may want to lift the vacuum cleaner 1 from the floor, for instance for cleaning a wall, a table, a windowsill, stairs or even a ceiling. In prior art cleaners comprising only the first handle 50, this is a very heavy operation to perform. By using a two-hand grip utilizing both the first handle 50 and the second handle 20, the lifting operation is greatly mitigated.

In the embodiment shown in FIG. 1, the second handle 20 is arranged to extend in a direction perpendicular to a longitudinal axis of the profile 23, and has an arch-like shape. Many different appropriate shapes may be envisaged for the second handle 20.

Figure 2A:
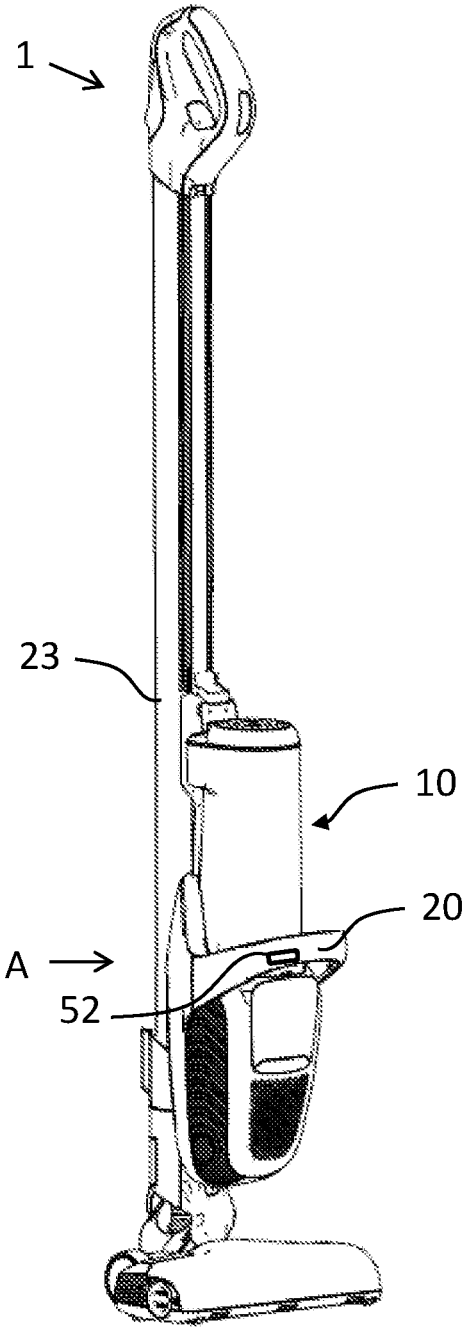
FIGS. 2*a* and 2*b* illustrate the FIG. 1 vacuum cleaner according to another embodiment with the housing in two different positions.
Figure 2B:
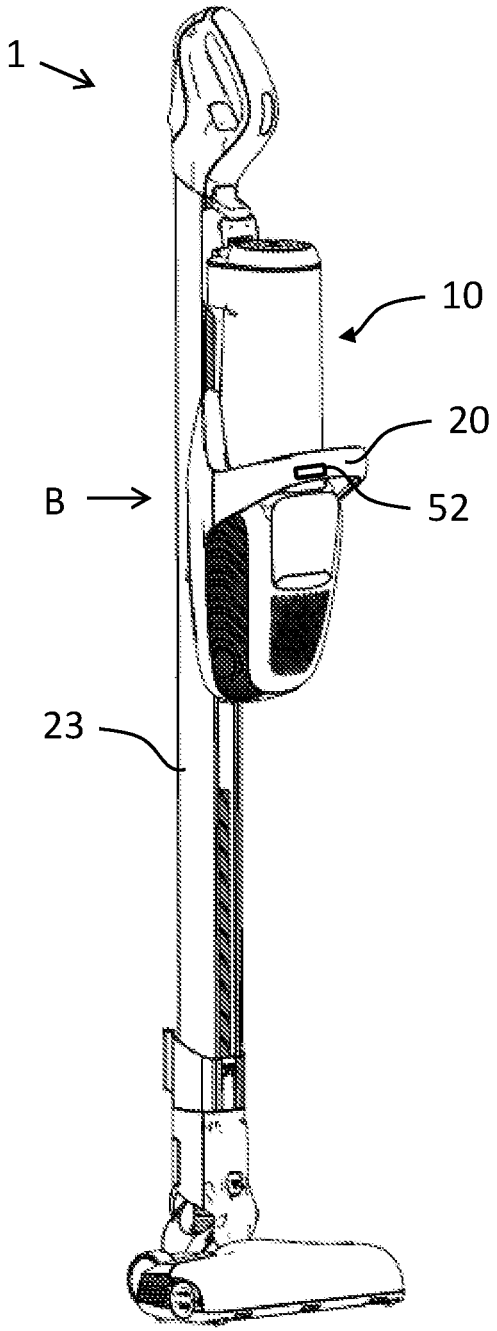

FIGS. 2*a* and 2*b* illustrate the vacuum cleaner 1 in a further embodiment where the housing 10 is arranged to be moveably attached to the profile 23, such that the housing 10 is moveable along at least a part of the length of the profile 23, either in distinct steps or continuously adjustable along the length of the profile 23.

Advantageously, the second handle 20 may be operated by a user to move the housing 10 along the profile 23. In an embodiment, the control mechanism 52 of the second handle 20 is arranged to control a locking mechanism (not shown) for locking the housing 10 to the profile 23 at different positions along the profile 23, and for releasing the locking to make it possible to move the housing 10 relative to the profile 23.

In FIG. 2*a*, the housing 10 is arranged in a first position A and in FIG. 2*b* the housing is arranged in a second position B. Since the first position A is closest to the nozzle it may sometimes be referred as a lower or downstream position when the vacuum cleaner is arranged in a standup position, and the second position B may sometimes be referred to as an upper or upstream position.

It is understood that the housing 10 can be arranged in a number of different positions along the length of the profile 23. The first position A and the second position B may serve as examples of housing positions. In some embodiments the housing 10 may be arranged in e.g. 2-6 distinct positions along the length of the profile 23. In some embodiments the housing 10 may be arranged to be freely slidable and to be attachable at any position along the length of the profile 23. The housing 10 may be fixed in a selected position by a latch of any kind and released when the latch is opened.

Advantageously, the second handle 20 attached to the housing 10 facilitates movement of the housing along the profile 23.

Figure 3A:
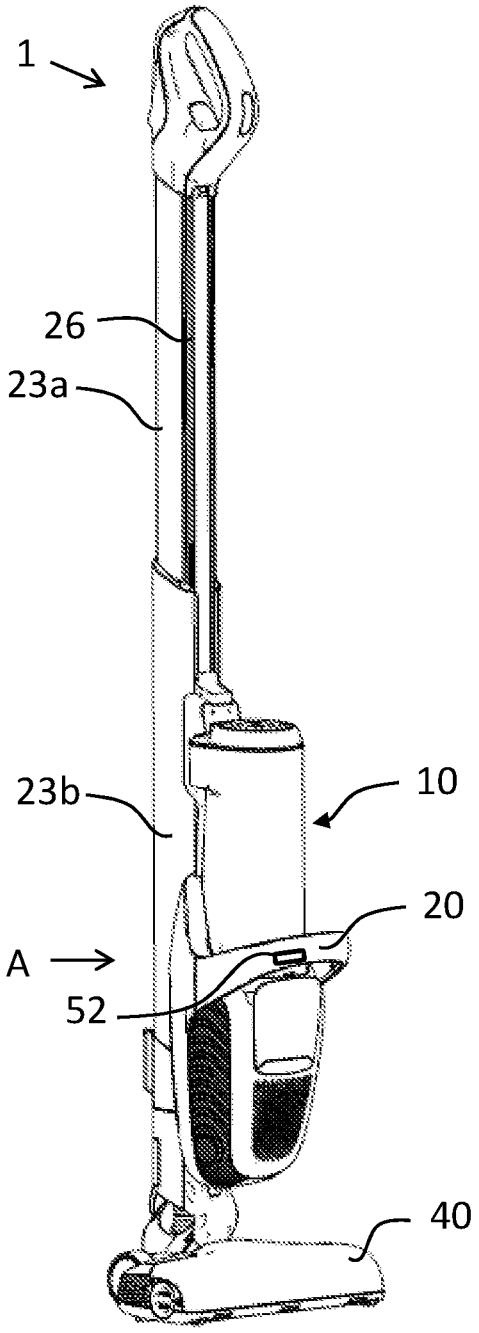
FIGS. 3*a* and 3*b* illustrates the FIG. 1 vacuum cleaner according to another embodiment being arranged with a telescopic profile.
Figure 3B:
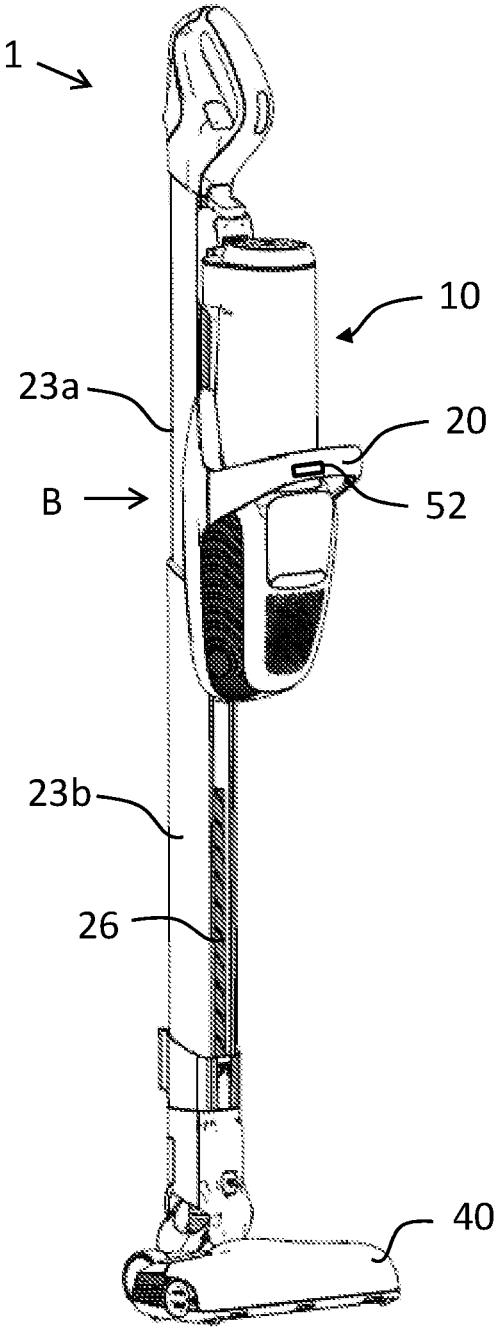

FIGS. 3*a* and 3*b* illustrate a further embodiment (which may or may not be combined with a moveably attached housing 10), where the profile 23 comprises a first profile part 23*a* and a second profile part 23*b*.

The second profile part 23*b* is arranged to at least partly enclose the first profile part 23*a*. In the embodiment illustrated in FIGS. 3*a* and 3*b*, the second profile part 23*b* is illustrated closest to the nozzle 40 of the vacuum cleaner 1. In other embodiments the first profile part 23*a* is closest to the nozzle 40. In other words, a profile part with a larger dimension, into which the other profile part may be slid, can selectively be arranged at an upper or lower position. The first profile part 23*a* is slidable or retractable in the second profile part 23*b* for adjustment of a length of the profile 23. The first profile part 23*a* and the second profile part 23*b* together thus form a telescopic profile 23. The vacuum cleaner 1 may comprise a locking mechanism or similar (not shown) for locking the first profile part 23*a* and the second profile part 23*b* relatively each other. In an embodiment, the control mechanism 52 of the second handle 20 is arranged to control the locking mechanism for locking the first profile part 23*a* and the second profile part 23*b* relatively each other and/or for releasing the locking. Further, as previously discussed, the control mechanism 52 of the second handle 20 may be arranged to control the locking of the housing 10 to the profile 23 at different positions along the profile 23, and for releasing the locking to make it possible to move the housing 10 relative to the profile 23.

Figure 4A:
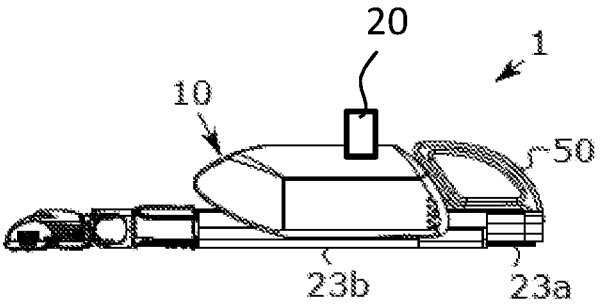
FIG. 4*a* illustrates a side view of the vacuum cleaner according to an embodiment when retracted.

In FIG. 4*a* illustrating a vacuum cleaner 1 of the type previously shown in FIGS. 3*a* and 3*b* but with a slightly different housing shape, the vacuum cleaner 1 is retracted and the first profile part 23*a* is to a high extent enclosed by the second profile part 23*b*. The handle 50 is in a folded position. This vacuum cleaner set-up may be suitable e.g. for vacuum cleaning of staircases.

Figure 4B:
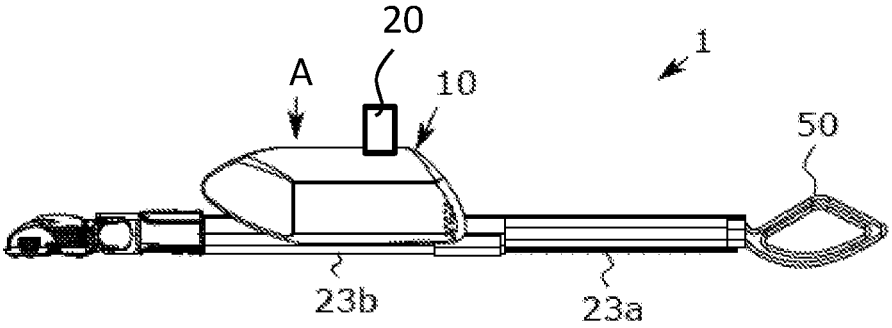
FIG. 4*b* illustrates the FIG. 4*a* vacuum cleaner when extracted and with the housing in a first position.

In FIG. 4*b* the vacuum cleaner 1 is extracted and only a small part of the first profile part 23*a* is enclosed by the second profile part 23*b*. The handle 50 is in an extended position. The housing 10 is in a lower position A. This vacuum cleaner set-up may be suitable e.g. during vacuum cleaning of floors when a relatively low point of gravity may be preferred.

Figure 4C:
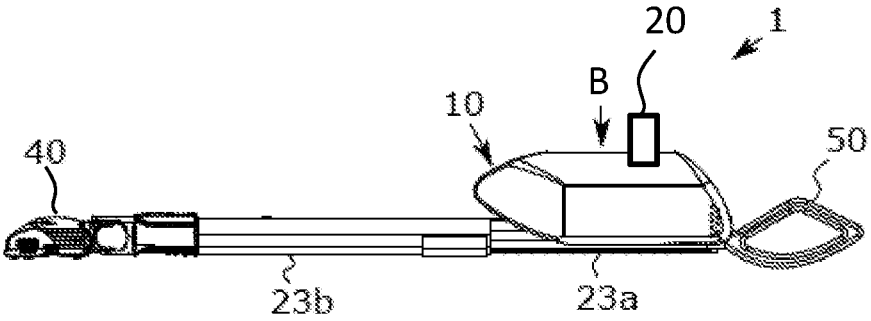
FIG. 4*c* illustrates the FIG. 4*b* vacuum cleaner with the housing in a second position.

In FIG. 4*c* the vacuum cleaner 1 is extracted and only a small part of the first profile part 23*a* is enclosed by the second profile part 23*b*. The handle 50 is in an open position. The housing 10 is in an upper position B. This vacuum cleaner set-up may be suitable e.g. during vacuum cleaning in situations where the nozzle 40 is higher up than the housing 10, such as when walls, high shelfs or ceilings are vacuum cleaned. Since the housing 10 is in the second position B, it will be relatively low when the vacuum cleaner has the nozzle 40 upwards. Thus, a relatively low point of gravity is achieved also during these vacuum cleaning operations. Further, this vacuum cleaner set-up may be advantageous for vacuum cleaning under low furniture's such as beds, sofas and the like. Since the housing 10 is in the first position A the nozzle 40 may reach far under a bed without being hindered by the housing 10.

As can be seen in FIGS. 4*b* and 4*c* in particular, the second handle 20 attached to the housing 10 is very helpful to a user for operating the vacuum cleaner 1.

In FIGS. 5*a*, 5*b* and 5*c* schematic cross sections of the vacuum cleaner 1 are illustrated. The housing 10 may comprise a motor fan unit 12, one or more filters 13 and a housing air inlet 14. The housing 10 may also comprise a dust separation device 19, such as a dust bag, a cyclone separator or a filter. The motor fan unit is capable of building up an under-pressure, thereby causing an airflow 60 to flow from an air inlet 61 at the nozzle 40 to the housing air outlet 11 via the housing air inlet 14 and an opening 25 in the profile.

FIG. 5*a* is a schematic cross section of the vacuum cleaner set-up illustrated in FIG. 4*a* with the housing 10 having the second handle 20, the first profile part 23*a* and the second profile part 23*b*. FIG. 5*b* is a schematic cross section of the vacuum cleaner set-up illustrated in FIG. 4*b*. FIG. 5*c* is a schematic cross section of the vacuum cleaner set-up illustrated in FIG. 4*c*.

In an embodiment where the housing is moveably attached to the profile 23 (or first or second profile parts 23*a* and 23*b*), the profile 23 will generally comprise a number of openings where the airflow is allowed to enter the housing air inlet 14 as the housing 10 is moved along the profile. Alternatively, the profile 23 is an open profile, where the section of the profile 23 facing the housing 10 is open, i.e. the profile is arranged with a single elongated opening 25.

Figure 6:
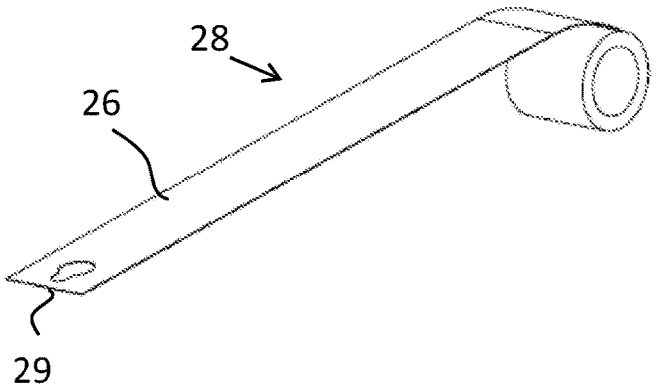
FIG. 6 illustrates a constant force spring with which the vacuum cleaner is equipped according to an embodiment.
Figure 7:
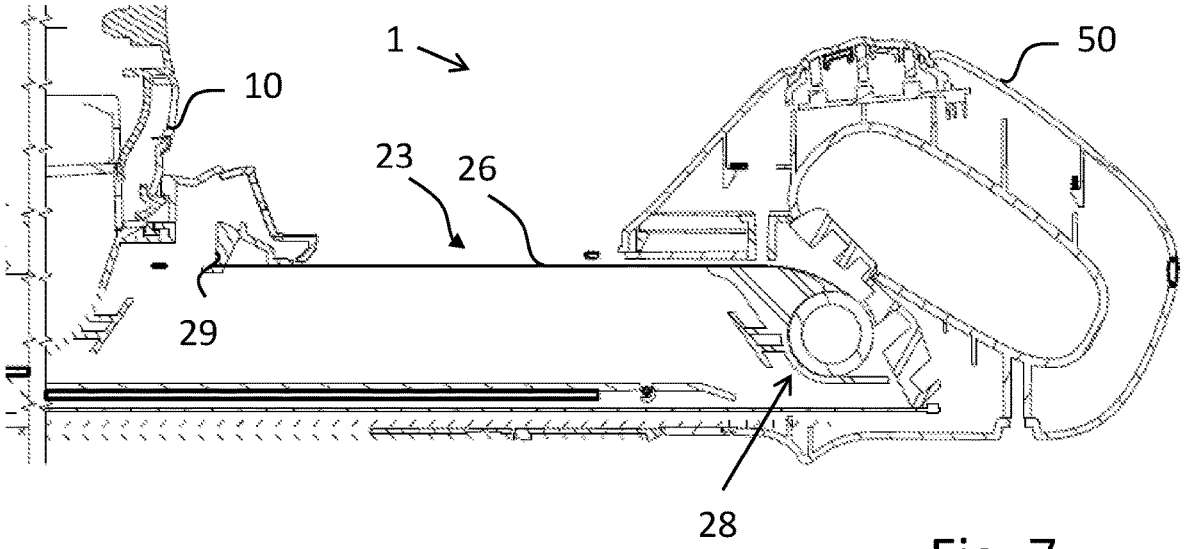
FIG. 7 illustrates the constant force spring being implemented in the vacuum cleaner according to an embodiment.

FIGS. 6 and 7 illustrates a constant force spring 28 according to an embodiment. FIG. 7 shows a cross-sectional view of an upper part of the vacuum cleaner 1. As shown in FIG. 7, the constant force spring 28 is mounted at the profile handle end 22 inside of the profile 23.

The constant force spring 28 is attached in one end 29 to be extended to the housing 10. Advantageously, the constant force spring 28 will provide a resilient support for the housing 10 and facilitate holding the housing 10 in place and thus prevent the housing 10 from uncontrollably moving in a downwards direction towards the nozzle.

Further in an embodiment, the part 26 of the spring 28 being extended may advantageously act as a cover means for any openings in the profile 23 which are not aligned with the air inlet 14 of the housing 10. A further cover means (not shown) may also be used for the part of the profile 23 located downstream of the housing 10 for covering any openings 25 located downstream of the housing, the further cover means for instance having the shape of a flexible cover strip for selectively closing off any opening(s) 25 not being aligned with the air inlet 14 of the housing 10.

In case of using an open profile, the single elongated opening not being aligned with the housing air inlet 14 is covered by the constant force spring 28 upstream of the housing 10, and said further cover means downstream of the housing 10.

The spring 28 may further be implemented in any one of the embodiments described with reference to FIG. 1-5.

The housing, profile arrangement, nozzle and handle may, at least partly, be made of plastics, metal or any other suitable material.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A vacuum cleaner comprising:

a profile extending between a profile nozzle end for attachment of a nozzle and a profile handle end for attachment of a first handle;

a housing attached to the profile, the housing comprising a motor fan unit configured to generate an airflow, a housing air outlet and a housing air inlet, the housing being movably mounted to slide along at least a part of the length of the profile;

an airflow channel extending from the profile nozzle end to the housing air outlet via the housing air inlet and the fan unit and configured to allow an airflow from the nozzle profile end to the housing air outlet; and a second handle positioned on the housing and configured to be operable by a user to move the vacuum cleaner, wherein the second handle comprises an arch defining an opening between the second handle and the housing, the arch extending in a direction perpendicular to a longitudinal axis of the profile from a first connection point to the housing to a second connection point to the housing;

wherein:

the profile comprises at least one opening via which the airflow enters the housing air inlet, the profile comprises at least one opening cover means, arranged to allow the airflow channel to a section of the at least one opening being aligned with the housing air inlet, the opening cover means is arranged to close off any remaining sections of the at least one opening not being aligned with the housing air inlet, and the opening cover means comprises a constant force spring mounted at the profile handle end inside of the profile, the constant force spring being attached in one end to be extended to the housing, wherein the said one end to be extended moves with the housing, wherein the constant force spring is configured to cover the at least one opening of the profile being located upstream of the housing.

2. The vacuum cleaner according to claim 1, wherein the housing is positioned on an upper side of the profile.

3. The vacuum cleaner according to claim 1, wherein the second handle is configured to be operable by a user to move the housing along the profile.

4. The vacuum cleaner according to claim 1, wherein the profile comprises a first profile part and a second profile part, the second profile part is arranged to at least partly enclose the first profile part and the first profile part is slidable in the second profile part for adjustment of a length of the profile.

5. The vacuum cleaner according to claim 1, wherein the first handle is pivotally attached to the profile handle end.

6. The vacuum cleaner according to claim 1, wherein the first handle comprises a control arrangement configured to control at least one of a fan effect and a nozzle function.

7. The vacuum cleaner according to claim 1, wherein the second handle is on an upper side of the housing.

8. The vacuum cleaner according to claim 4, wherein the second profile part comprises an opening extending along the second profile part and configured to receive the housing air inlet to allow the housing air inlet to slide along the second profile part.

* * * * *